US006491117B2

(12) United States Patent
Ruttley

(10) Patent No.: US 6,491,117 B2
(45) Date of Patent: Dec. 10, 2002

(54) APPARATUS FOR RETRIEVING METAL DEBRIS FROM A WELL BORE

(75) Inventor: David J. Ruttley, Marrero, LA (US)

(73) Assignee: Rattler Tools, Inc., Harvey, LA (US)

( * ) Notice: Subject to any disclaimer, the term of this patent is extended or adjusted under 35 U.S.C. 154(b) by 0 days.

(21) Appl. No.: 09/827,116

(22) Filed: Apr. 5, 2001

(65) Prior Publication Data

US 2002/0057151 A1 May 16, 2002

Related U.S. Application Data

(63) Continuation-in-part of application No. 09/422,423, filed on Oct. 21, 1999, now Pat. No. 6,216,787.

(51) Int. Cl.[7] ..... E21B 21/00; E21B 10/00; E21C 25/04

(52) U.S. Cl. ..... 175/328; 166/66.5

(58) Field of Search ..... 175/328; 166/66.5, 166/311

(56) References Cited

U.S. PATENT DOCUMENTS 2,965,406 A * 12/1960 Le Bus, Sr. ..... 166/66.5
3,637,033 A * 1/1972 Mayall ..... 175/320
5,052,491 A * 10/1991 Harms et al. ..... 166/304

* cited by examiner

*Primary Examiner*—Ramon M. Barrera
(74) *Attorney, Agent, or Firm*—Keaty Professional Law Corporation

(57) ABSTRACT

A tool for retrieving metal debris from a wellbore has a plurality of magnet assemblies spaced longitudinally along a tool body. Each magnet assembly has a magnet member, which forms a primary debris settling area. Each magnet member is protected by a magnet protector. A secondary debris settling area is formed between a magnet and an adjacent magnet protector to allow utilization of the residual magnetic force created by the magnet members. The secondary debris settling area occupies at least half of the surface area of the primary settling area.

14 Claims, 4 Drawing Sheets

APPARATUS FOR RETRIEVING METAL DEBRIS FROM A WELL BORE

CROSS-REFERENCE TO RELATED APPLICATIONS

This application is a continuation-in-part of my co-pending application, Ser. No. 09/422,423 filed on Oct. 21, 1999 entitled "An Apparatus for Retrieving Metal Objects from a Well Bore", now U.S. Pat. No. 6,216,787 issued on Apr. 17, 2001, the full disclosure of which is incorporated by reference herein.

BACKGROUND OF THE INVENTION

The present invention relates to well bore tools and, more particularly, to an apparatus for retrieval of metal debris, such as cuttings, shavings, and other foreign objects that accumulate in the process of perforating or milling over bridge plugs and other down hole obstructions from a well bore.

The oil and gas industry uses various types of bridge plugs that are installed in the annulus and often are covered in cement when the well is completed. Removal of these plugs often poses a problem for the industry. Conventionally, a rotary bit drills the cement and the plugs out, while some of the cuttings of the plugs are carried to the surface by circulating liquids.

Sometimes, a production packer needs to be removed together with a metal pipe that it surrounds. In those cases, milling tools with gravity fed boot baskets are used for retrieving pieces of metal debris from the well bore. After retrieval of the production packer, it may become necessary to run a conventional fishing magnet to retrieve additional junk and cuttings from down hole.

A conventional fishing magnet is mounted inside a housing that is lowered into a well bore. It is limited in the ability to retrieve cuttings in that its magnetization is restricted to the extreme bottom surface of the magnet. The fact that circulating fluids lift the cuttings away from the bottom surface of the magnet renders such conventional fishing magnets useless in this particular case.

Oftentimes, a boot basket is used for collecting cuttings that did not attach themselves to conventional magnets. A boot basket has small openings for catching these particles. Consequently, many large size pieces or very small pieces suspended in the circulating fluid are not trapped in the basket and remain in the well bore, hindering the production of oil.

Another solution for retrieving debris from a well bore is to lower a magnet to a down hole location in an effort to attract metal waste material from the well bore. One such example is shown in U. S. Pat. No. 3,637,033 issued on Jan. 25, 1972 to Mayall, entitled "Drilling Apparatus." In the '033 patent, the tool for collecting magnetic waste material has an inner and outer coaxial tubular members made of non-magnetic material. A plurality of magnets is located between the tubular members, with the axes of the magnets being parallel to the common longitudinal axis of the tubular member. The magnets are secured on the tubular member, and recesses are formed between the magnets parallel to the longitudinal axis. Each recess occupies the space between the adjacent sides of two magnets.

The outer tubular member in the '033 patent is made of stainless steel, and strips of non-magnetic material are welded to the outer tubular member at the base of each recess. The magnets are enclosed by the outer tubular member to protect the magnets against forceful contact with shavings attracted by the magnets when the tubular member is rotated.

While this design works in many cases, it has been observed that the outer sleeve somewhat obstructs the magnetic flux of the magnets and reduces the amount of magnetic waste that is retrieved by the tool.

The present invention contemplates elimination of drawbacks associated with the prior art and provision of a well bore apparatus for removal of metal debris, such as cuttings, shavings and other foreign particles from a well bore.

SUMMARY OF THE INVENTION

It is, therefore, an object of the present invention to provide an apparatus for retrieval of metal cuttings and other debris from a well bore.

It is another object of the present invention to provide an apparatus for retrieval of metal debris with increased "catching" capacity of the tool.

It is a further object of the present invention to provide an apparatus for retrieval of metal debris from a well bore that protects the magnets, while creating additional areas where the cuttings can accumulate for retrieval to the surface.

These and other objects of the present invention are achieved through a provision of a metal debris retrieval tool that comprises a cylindrical tubular body with a through opening and a plurality of recesses formed on the tool body. Each recess receives a magnet assembly therein. Each magnet assembly comprises a magnet liner fitted into the recess and a magnet member placed on the liner and detachably secured on the tool body.

The magnet members are protected against direct impact with the metal particles by a magnet protector formed by an outwardly extending portion of the tool body. To take advantage of the residual magnetic force created by the magnets, a plurality of secondary debris settling areas are created on the tool body between a magnet member and a magnet protector of an adjacent magnet member.

BRIEF DESCRIPTION OF THE DRAWINGS

Reference will now be made to the drawings, wherein like parts are designated by like numerals and wherein.

DETAIL DESCRIPTION OF THE PREFERRED EMBODIMENT

Figure 1:
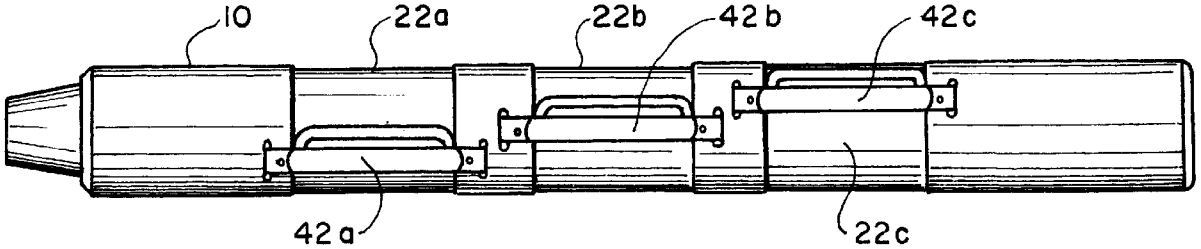
FIG. 1 is a side view of the apparatus for retrieving metal debris in accordance with the present invention.
Figure 2:
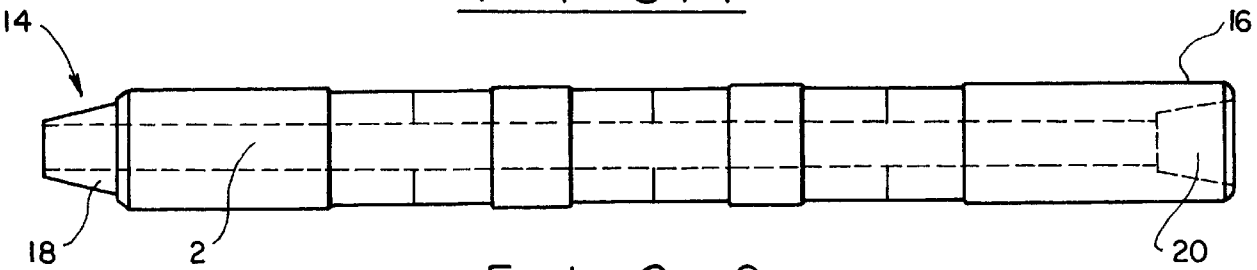
FIG. 2 is a side view of the tubular tool body with a pin and box connection.

Turning now to the drawings in more detail, numeral 10 designates the tool body of the apparatus of the present invention. The tool body 10 is a generally cylindrical tubular body having a central through opening 12 that extends from the first end 14 of the tool body to the second end 16 thereof. A pin connector 18 is formed on the first end 14 of the body 10, and a box connector 20 is formed in the second end 16 of the tool body 10. The tool body 10 is provided with recessed portions 22 (three recesses 22*a*, 22*b*, 22*c* shown in FIG. 1) within which magnet members are secured.

Figure 7:
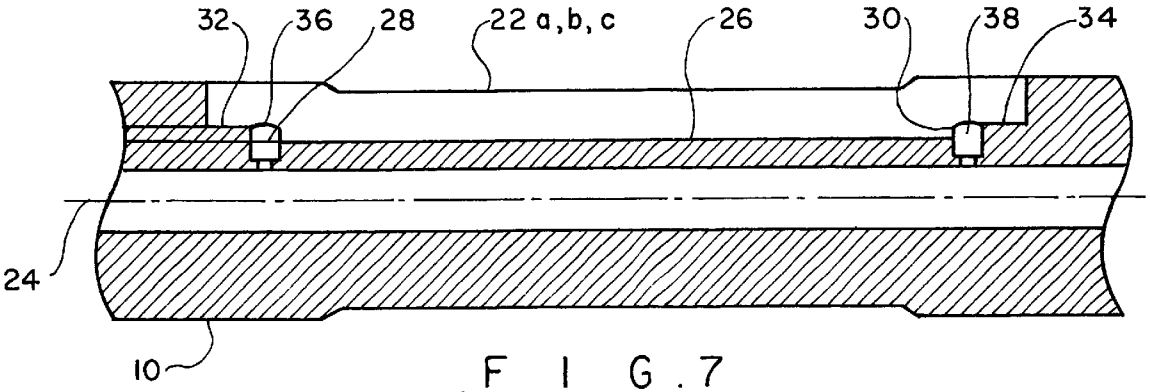
FIG. 7 is a detail cross-sectional view showing a recess cut out in the body of the tool for positioning of a magnet therein.
Figure 8:
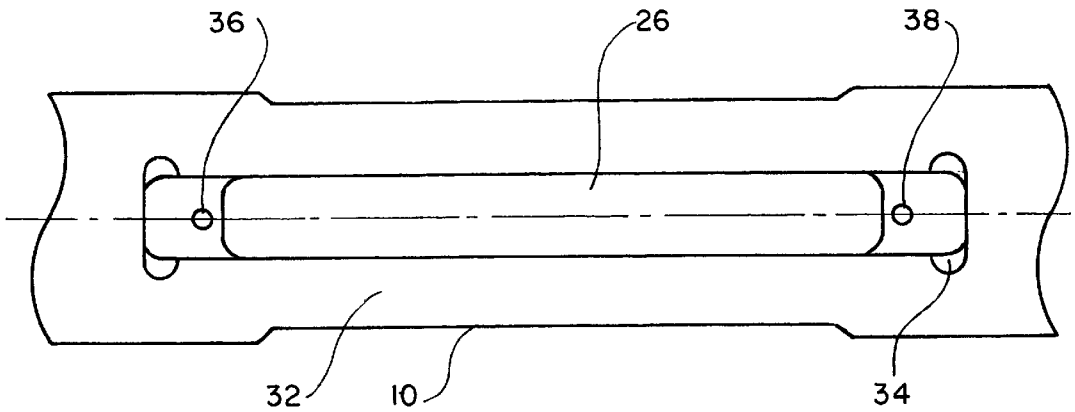
FIG. 8 is a detail top view showing the slot area for receiving a magnet.

As can be seen in more detail in FIGS. 7 and 8, each recessed portion 22*a, b,* and *c* is formed by a cut out in the tool body that extends longitudinally along the outer surface of the tool body 10, parallel to the central axis 24 of the tool body 10. Each cut out 22 has an inner surface 26, defined by a first transverse shoulder 28 and a second transverse shoulder 30. The shoulders 28 and 30 extend perpendicularly to the central axis 24. A second cut out level is defined by opposing surfaces 32 and 34, which are shorter than the surface 26. A pair of indentations 36 and 38 is formed in the surfaces 32 and 34, respectively. The indentations 36 and 38 are designed to receive securing bolts or screws, as well be described in more detail below.

Figure 9:
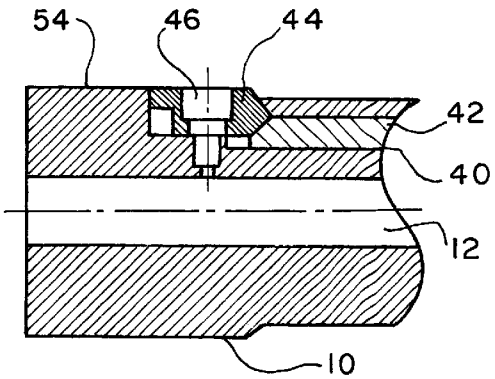
FIG. 9 is a detail cross-sectional view showing positioning of a magnet and securing thereof with a lug within a recess.

A magnet liner 40 is positioned inside each recess 22 in contact with the surface 26, as shown in FIG. 9. A magnet member 42 is placed above the liner 40, and securing lugs 44 are placed over the magnet 42 within the recesses 22. Securing screws 46 are placed through the lugs 44 to keep the lugs 44, magnet member 42 and the liner 40 in place on the tool body 10.

Each magnet member 42, if damaged or worn out, can be easily detached and replaced by first removing the screws 46, then disengaging the lugs 44, and finally lifting the magnet member 42 from the recess 22. Each magnet member is individually secured and can be replaced, when necessary, without affecting other magnet members or requiring disassembly of the entire tool.

Figure 6:
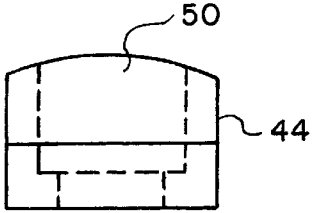
FIG. 6 is a cross-sectional view of a lug taken along lines 6—6 of FIG. 5.
Figure 5:
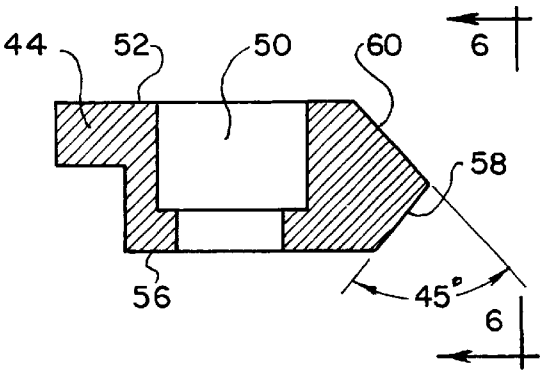
FIG. 5 is a detail view showing a lug used for securing magnets to the tubular body.

As shown in more detail in FIGS. 5 and 6, each lug 44 is provided with a through opening 50 adapted to receive securing screws therein. The top surface 52 of the lug 44 is relatively smooth and straight and extends in a generally co-planar relationship to an exterior surface 54 of the tool body 10. The bottom surface 56 of the lug 44 is also straight for contacting the cut out surfaces 32 or 34 of the recess 22. Two surfaces of each lug 44 are cut at an angle. The surface 58 of each lug 44 is cut at about a 45-degree angle to match the profile of a magnet 42 and ensure a good contact with the surface of the magnets. The second downwardly inclined surface 60 of the lug 44 matches the cut out surface of the tool body 10 (see FIG. 9).

Turning again to FIG. 1, the position of the magnet members 42 is shown in more detail. As can be seen in the drawing, the magnet members are positioned within their corresponding recesses, with magnet member 42*a* positioned in the recess 22*a*, magnet member 42*b* positioned in the recess 22*b*, and magnet member 42*c* positioned within the recess 22*c*. The magnet members 42*a*, 42*b*, and 42*c* are positioned in a longitudinal relationship along the tool body 10, parallel to the central axis 24 of the tool body 10 and in a parallel relationship to each other. As a result, a step up orientation of the magnet members 42*a*, 42*b*, and 42*c* is formed on each tool body 10, i.e. the magnets 42 are not vertically aligned on a particular tool body.

Figure 3:
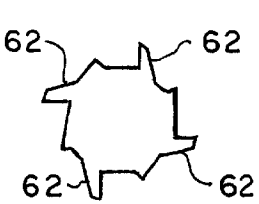
FIG. 3 is a detail view showing orientation of the magnet protectors in an exemplary four-magnet tool.
Figure 4:
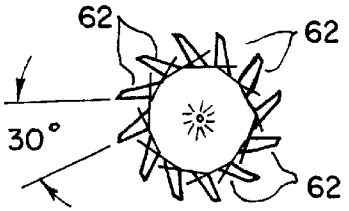
FIG. 4 is a detail end view showing orientation of the magnet protectors when three tools of the present invention are connected end-to-end and lowered into a well bore.

The number of magnet members 42 in each particular tool differs and can be two or more in number. Each magnet member 42 is provided with a protective member, or magnet protector 62. The embodiment of FIG. 3 shows four magnet protectors 62. When two or more tool bodies 10 are connected end-to-end to each other through the pin and box connections 18 and 20, the end view of the tool lowered down hole, as for instance seen in FIG. 4, resembles spokes on a wheel.

Figure 10:
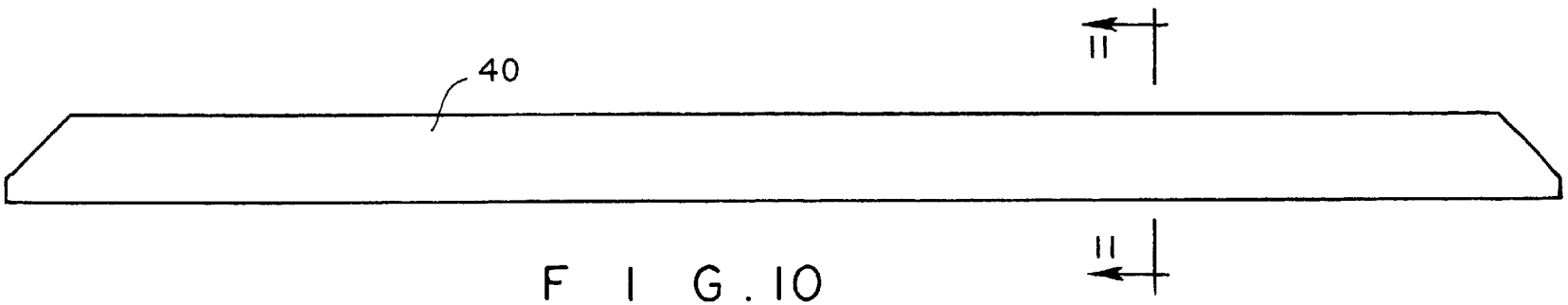
FIG. 10 is a detail side view of a magnet liner.
Figure 11:
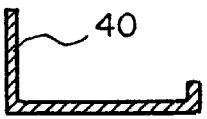
FIG. 11 is a cross-sectional view of the magnet liner taken along lines 11—11 of FIG. 10.

FIG. 10 illustrates a side view of an L-shaped magnet liner 40. FIG. 11 illustrates a cross-section view of the magnet liner taken along lines 11—11 of FIG. 10. Each magnet liner is configured to match the profile of the magnet, the recess 22 and the lug 44. The magnet liner 40 may be made from brass or other similar non-corrosive material.

Figure 12:
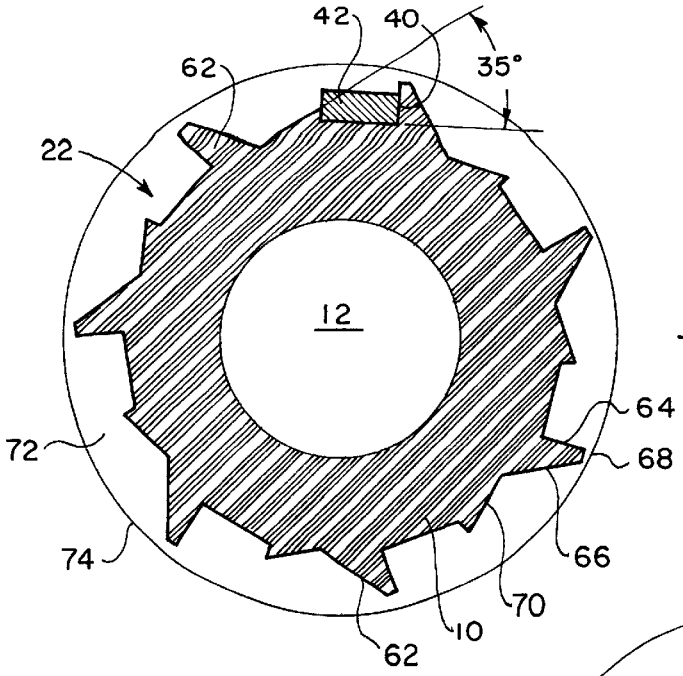
FIG. 12 is a cross-sectional view showing an exemplary seven-magnet tool.
Figure 14:
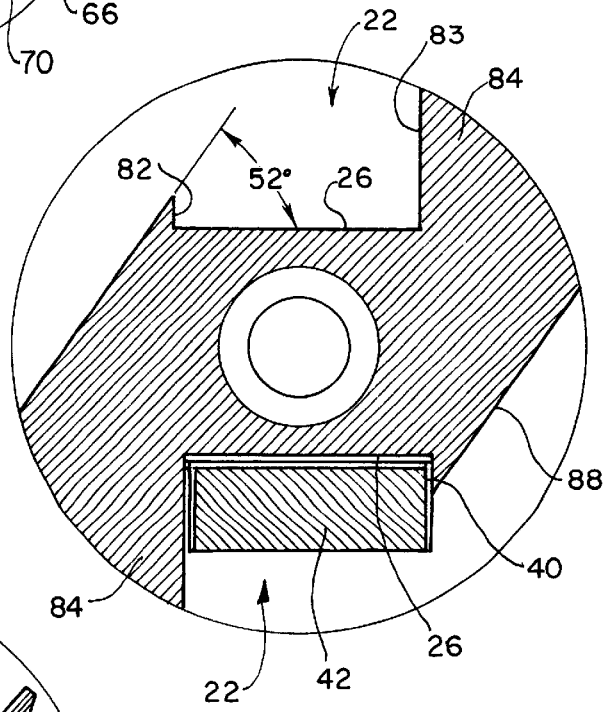
FIG. 14 is a cross-sectional view showing an exemplary two-magnet tool of the present invention.
Figure 13:
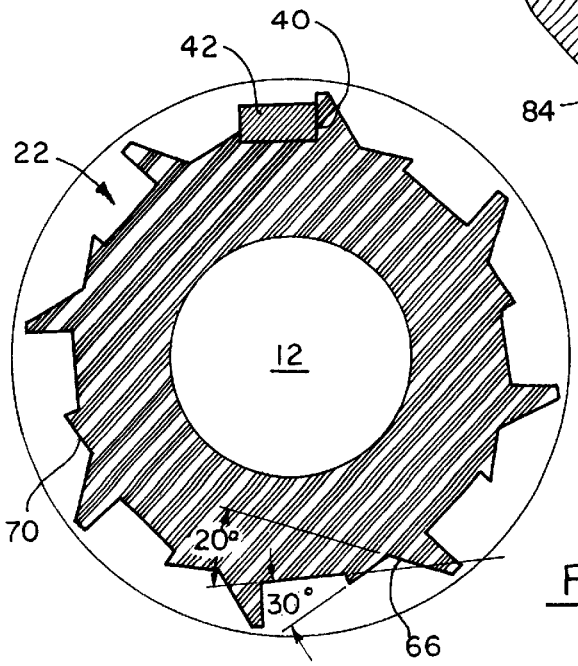
FIG. 13 is a cross-sectional view showing an exemplary eight-magnet tool.

Turning now to FIGS. 12–14, various embodiments of the multi-magnet tool of the present invention are illustrated. FIG. 12 illustrates a seven-magnet tool of the present invention, although only one magnet 42 is shown for clarity. FIG. 13 illustrates an exemplary eight-magnet tool although only one magnet member is shown placed in a recess 22, it is to be understood that each recess 22 carries a magnet therein.

Each magnet member 42 is provided with an outwardly extending magnet protector 62. Each magnet protector 62 has a first surface 64 which contacts the liner 40, a second, inclined surface 66 and the outermost point 68 which extends farther than the magnet member 42, as can be seen in FIGS. 12–14. The magnet protectors shield the magnets from a forceful impact with the metal objects attracted by the magnets when the tool is rotated in a well bore.

The apparatus of the present invention has a primary debris settling are defined by the exterior surface of the magnet member 42 and a secondary debris settling area defined by a surface 70, which is located immediately behind the inclined surface 68 of the protector 62. During tests, it was observed that the strongest magnetic force is created immediately adjacent to the magnet members 42, and less powerful magnetic force extends in the areas adjacent to the magnet members 42. It was also observed that this secondary force is capable of collecting a considerable amount of metal cuttings and shavings, almost equal to the main force distributed by the magnet members 42.

The present invention takes advantage of this secondary force and provides a tool with large surface area designed as a secondary settling area 70 immediately adjacent each magnet protector 62. This large settling area dramatically improves the capability of the apparatus of the present invention to retrieve metal objects from a well bore.

The surface 70 occupies at least 50 per cent of the surface area created by the exposed magnet surfaces. When the tool body 10 with the magnets 42 is rotated in the well bore, metal debris is attracted by the magnets 42, settling on the exposed surfaces of the magnet members and also settling on the surfaces 70. The metal debris, not immediately settling on the magnet members 42 tends to be pushed toward the area 70, where it attaches to the tool body 10 and is retrieved along with the tool body to the surface.

Each secondary settling area 70 is preferably inclined in relation to the surface 26 of the recess 22. The degree of incline of the surface 70 differs depending on the number of magnet members used. For instance, in a seven-magnet tool (FIG. 12) the surface 70 extends at about 35 degrees in relation to the surface 26 of the recess 22. In the eight-magnet tool (FIG. 13), the surface 70 is inclined at about 30 degrees in relation to the surface 26 and in a two-magnet tool (FIG. 14), the surface 70 extends at about 52 degrees in relation to the surface 26. Of course, these values are merely exemplary and may be modified by tool designers depending on the diameter of the tool, the strength of the magnet used and other design criteria.

Turning now to the embodiment of FIG. 14, the tool of the present invention utilizing two magnets is illustrated. This particular embodiment of the apparatus of the present invention may be used with a small diameter tool body, for instance, 2¾ inch outside diameter. As shown in FIG. 14, there are two recesses 22 formed in the tool body. The recesses are mirror images of each other and form an L-shaped configuration in cross-section. The recesses 22 are defined by the inner surface 26, which forms the longer side of the stylized letter "L" a shorter side 82 and an opposing side 83.

Although only one magnet is shown in place in FIG. 14, it will be understood that each recess 22 holds a liner 40 and a magnet 42. It is envisioned that the embodiment of FIG. 13 can be used with larger diameter tools, for instance an 8-inch diameter, while the embodiment of FIG. 14 may be used with smaller size tools.

A magnet member 42 (only one shown) is fitted within each of the recesses 22 and the portion of the tool body 84 adjacent to the side 83 serves as a magnet protector. A magnet liner 40 is fitted in the recess 22 in contact with the surfaces defining the recess 22. The secondary settling area, or surface 88 is formed behind the magnet member 42. The secondary settling surface 88 is inclined at about a 52-degree angle in relation to the surface 26. Of course, the degree value can differ, depending on the manufacturing choice.

Figure 15:
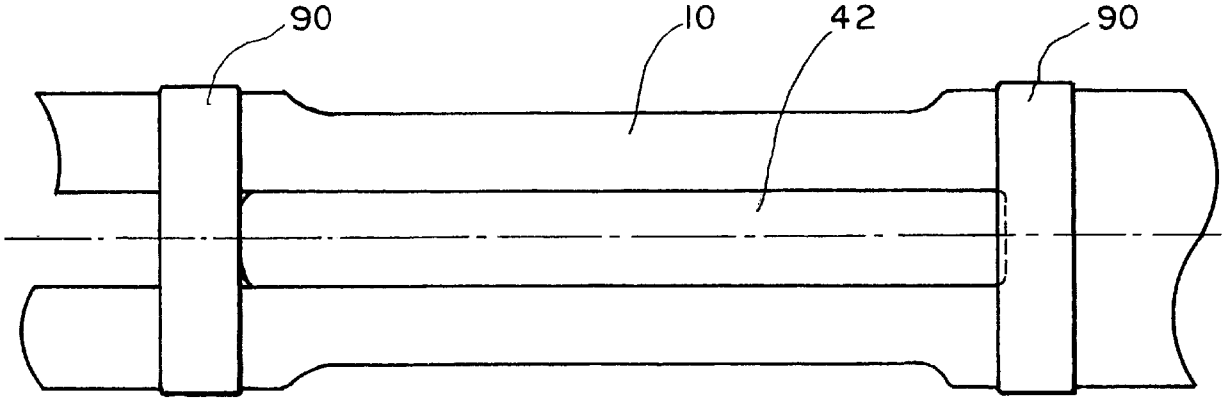
FIG. 15 is a detail view showing the use of securing rings in relation to a magnet.

FIG. 15 illustrates still another embodiment of the tool of the present invention, wherein rings are used for securing the magnet member 42 on the tool body 10. The rings 90 instead of lugs and screws are placed over the opposing ends of the magnet member 42, adjacent its upper and lower ends, and over the tool body 10. The rings 90 prevent the magnet members 42 from disengaging from the recesses 22 when the tool is rotated.

The apparatus of the present invention is designed to maximize the heretofore unused area in the magnetic retrieval tool by creating large secondary settling surfaces positioned behind the magnet members. By connecting two or more tool bodies 10 with the magnets secured thereon, the apparatus of the present invention can maximize the amount of metal debris retrieved from the well bore by creating a 360 degree magnetic field. The number of magnets in such design applications can be reduced while retaining the magnetic strength necessary for retrieval of a considerable amount of metal debris located in the well bore. The flux field is increased without increasing the number of magnets.

A certain balance needs to be observed when forming recesses in the tool body. Smaller diameter tools may lose their structural integrity if too many recesses are cut in the tool body. The recesses form weak points in the tool body, especially when the tool is lowered down hole, rotated and metal objects are allowed to settle thereon. The present invention takes into consideration the diameter of the tool body, the configuration and the number of recesses that are possible given certain sizes of the tool body and the amount surface area for the metal debris to settle.

In the embodiment of the present invention, the number of magnets used can be two or more, depending on the tool body diameter and the anticipated amount of debris that is to be retrieved from the well bore. By placing the tool bodies in a coaxial alignment with each other, end-to-end, a 360-degree magnetic exposure can be achieved to maximize the magnetic force of the retrieval tool.

Many changes and modifications can be made in the design of the present invention without departing from the spirit thereof. I, therefore, pray that my rights to the present invention be limited to only by the scope of the appended claims.

I claim:

1. An apparatus for retrieving metal debris from a wellbore, comprising:

a cylindrical tool body with a central opening therethrough;

a plurality of sets of magnet assemblies spaced longitudinally along the length of the tool body, each set comprising a plurality of magnet assemblies spaced circumferentially about the outer circumference of the tool body, said magnet assemblies each having an exterior surface defining primary debris settling area, each of said sets of magnet assemblies comprising an elongated magnet member spaced longitudinally from a magnet member of another set of magnet assemblies secured on the tool body in a non-coaxial relationship to each other, each of said magnet assemblies comprising a magnet liner, each magnet liner being secured within a recess formed in said tool body, and wherein each of said magnet members is fitted in said magnet liner;

a magnet protector formed immediately adjacent to each of the magnet assemblies and extending outwardly from said tool body; and a plurality of secondary debris settling areas, each secondary debris settling area being defined by the tool body in locations between a magnet assembly and a magnet protector of an adjacent magnet assembly.

2. The apparatus of claim 1, wherein each of said magnet assemblies comprises a magnet member detachably secured on said tool body in a recess formed in the tool body.

3. The apparatus of claim 1, wherein each of said magnet protectors is provided with a slanted exterior surface for deflecting metal particles and preventing damage to an immediately adjacent magnet member.

4. The apparatus of claim 3, wherein one side of said magnet protectors has a length greater than a corresponding side of the immediately adjacent magnet member to thereby protect the magnet member from striking force of a metal object being attracted by the magnet member.

5. The apparatus of claim 1, wherein said each of said secondary settling areas has at least half as much surface area as the primary settling area.

6. The apparatus of claim 1, wherein said tool body is provided with a plurality of recesses for receiving said magnet members therein.

7. The apparatus of claim 1, further comprising retainer rings mounted between longitudinally spaced magnet assemblies for detachably securing said magnet assemblies on the tool body.

8. An apparatus for retrieving metal debris from a wellbore, comprising: a cylindrical tool body with a central opening therethrough;

a plurality of sets of magnet assemblies spaced longitudinally along the length of the tool body in a coaxial relationship to each other, each set comprising a plurality of magnet assemblies spaced circumferentially about the outer circumference of the tool body, each of said magnet assemblies comprising a magnet member detachably secured on said tool body, each of said magnet members having an exterior surface defining a primary debris settling area;

a magnet protector formed immediately adjacent each of the magnet assemblies and extending outwardly from said tool body; and a plurality of secondary debris settling areas, each secondary debris settling area being defined by the tool body in locations between a magnet assembly and a magnet protector of an adjacent magnet member, each secondary debris settling area having a least half as much surface area as the immediately adjacent primary settling area.

9. The apparatus of claim 8, wherein each of said magnet assemblies further comprises a magnet liner, each magnet liner being secured within a recess formed in said tool body, and wherein each of said magnet members is fitted in said magnet liner.

10. The apparatus of claim 8, wherein each of said magnet protectors is provided with a slanted exterior surface for deflecting metal particles and preventing damage to an immediately adjacent magnet member.

11. The apparatus of claim 8, wherein one side of each of said magnet protectors has a length greater than a corresponding side of the immediately adjacent magnet member to thereby protect the magnet member from striking force of a metal object being attracted by the magnet member.

12. An apparatus for retrieving metal objects from a wellbore, comprising:

a cylindrical tool body with a central opening therethrough and a plurality of recesses formed on said tool body;

a plurality of sets of magnet assemblies spaced longitudinally along the length of the tool body in a coaxial parallel relationship to each other, each set comprising a plurality of magnet assemblies spaced circumferentially about the outer circumference of the tool body, each of said magnet assemblies comprising of an L-shaped magnet liner, each magnet liner being fitted in a corresponding recess of the tool body and a magnet member, each magnet member placed in a corresponding magnet liner, said each of said magnet members defining a primary debris settling area;

a magnet protector formed by the tool body immediately adjacent each of the magnet assemblies; and a plurality of secondary debris settling areas, each secondary debris settling area being defined by the tool body in locations between a magnet assembly and a magnet protector of an adjacent magnet member, each seondary debris settling area having at least half as much surface area as the immediately adjacent primary settling area.

13. The apparatus of claim 12, wherein each of said magnet protector members is provided with a slanted exterior surface for deflecting metal particles and preventing damage to an immediately adjacent magnet member.

14. A method of retrieving metal particles from a well bore, comprising the following steps:

providing a tool body having a central opening therein;

providing a plurality of magnet assemblies longitudinally spaced along said tool body, said magnet assemblies defining a primary settling area, each of said magnet assemblies comprising a magnet liner, each magnet liner being secured within a recess formed in said tool body, and wherein each of said magnet members is fitted in said magnet liner;

providing a magnet protector for each of said magnet assemblies for deflecting a striking force of said metal particles on said magnet assemblies;

forming secondary particles settling area on said tool body for attracting the particles by a residual magnetic force created by the magnet assemblies, said secondary particles settling area being defined by the tool body in locations between a magnet assembly and a magnet protector of an adjacent magnet assembly, said secondary particles settling area having at least half as much surface area as the primary settling area;

lowering said body into the well bore and imparting rotation to said tool body, thereby creating a magnetic field and causing metal particles to settle on said primary and said secondary particles settling areas.

* * * * *